US008934635B2

(12) United States Patent
Esnault et al.

(10) Patent No.: US 8,934,635 B2
(45) Date of Patent: Jan. 13, 2015

(54) METHOD FOR OPTIMIZING THE STEREO RECEPTION FOR AN ANALOG RADIO SET AND ASSOCIATED ANALOG RADIO RECEIVER

(75) Inventors: Thomas Esnault, Paris (FR); Frédéric Amadu, Chelles (FR)

(73) Assignee: Arkamys, Paris (FR)

( * ) Notice: Subject to any disclaimer, the term of this patent is extended or adjusted under 35 U.S.C. 154(b) by 383 days.

(21) Appl. No.: 13/519,036

(22) PCT Filed: Dec. 21, 2010

(86) PCT No.: PCT/FR2010/052865

§ 371 (c)(1),
(2), (4) Date: Jun. 25, 2012

(87) PCT Pub. No.: WO2011/077041

PCT Pub. Date: Jun. 30, 2011

(65) Prior Publication Data

US 2012/0288098 A1 Nov. 15, 2012

(30) Foreign Application Priority Data

Dec. 23, 2009 (FR) ..... 09 59552

(51) Int. Cl.
*H04H 20/47* (2008.01)
*H04H 40/63* (2008.01)
*G10L 19/008* (2013.01)

(52) U.S. Cl.
CPC ..... *H04H 40/63* (2013.01); *G10L 19/008* (2013.01)
USPC ..... 381/2; 381/10; 381/17; 381/303; 381/22; 700/94; 455/135

(58) Field of Classification Search
CPC ..... G10L 19/008; G10L 19/167; G10L 19/26; G10L 25/60; G10L 19/24; H04R 2205/041; H04R 2499/13; H04R 5/02; H04S 1/00; H04S 1/002; H04S 1/005; H04S 1/007; H04S 5/00; H04S 5/005; H04S 5/02; H04S 7/302; H04S 7/305; H04S 7/306; H04S 7/307; H04S 2400/09; H04S 2420/03; H04S 2420/11; H04S 2420/13; H04S 2420/01; H04S 3/00; H04S 3/008; H04H 60/04
USPC ..... 381/1, 10, 11, 12, 13, 15, 17, 18, 22, 381/23, 23.1, 302, 303, 309, 310, 311, 26, 381/27, 61, 316, 317, 320, 321, 71.13, 381/71.14, 80, 81, 86, 94.1, 94.2, 94.9; 700/94; 704/263, 216, 217, 218, 237; 455/135, 226.3
See application file for complete search history.

(56) References Cited

U.S. PATENT DOCUMENTS 4,037,057 A * 7/1977 Ogita et al. ..... 381/10
5,636,324 A 6/1997 Teh et al.

(Continued)

FOREIGN PATENT DOCUMENTS

JP 2003174373 A * 6/2003
JP 2007 079483 A 3/2007
WO WO 2009/010116 A1 1/2009

*Primary Examiner* — Leshui Zhang
(74) *Attorney, Agent, or Firm* — Im IP Law PLLC; C. Andrew Im

(57) ABSTRACT

A method of optimizing stereo reception for an analog radio by applying the demodulated right sound signal (SD) and left sound signal (SG) as input to a decorrelation module having a variable decorrelation rate. The decorrelation rate of the decorrelation module is modified as a function of the reception quality coefficient "alpha" provided by the radio. The decorrelation module applies a higher decorrelation rate for a smaller reception quality coefficient "alpha" and applies a lower decorrelation rate for a larger reception quality coefficient "alpha. Also, a module for generating high-pitched sounds to recreate the high-frequency component (SHF) of the right or left sound signals which has been removed in the event of poor reception.

16 Claims, 3 Drawing Sheets

(56) References Cited

U.S. PATENT DOCUMENTS

| | | | | |
|---|---|---|---|---|
| 2002/0154783 | A1 | 10/2002 | Fincham | |
| 2005/0157883 | A1 | 7/2005 | Herre et al. | |
| 2006/0046676 | A1 | 3/2006 | Benz et al. | |
| 2008/0031463 | A1* | 2/2008 | Davis | 381/17 |
| 2009/0036085 | A1* | 2/2009 | Kobayashi | 455/296 |
| 2009/0055194 | A1* | 2/2009 | Hotho et al. | 704/500 |
| 2009/0279706 | A1* | 11/2009 | Takashima | 381/17 |

* cited by examiner

METHOD FOR OPTIMIZING THE STEREO RECEPTION FOR AN ANALOG RADIO SET AND ASSOCIATED ANALOG RADIO RECEIVER

RELATED APPLICATIONS

This application is a §371 application from PCT/FR2010/052865 filed Dec. 21, 2010, which claims priority from French Patent Application No. 09 59552 filed Dec. 23, 2009, each of which is incorporated herein by reference in its entirety.

TECHNICAL FILED OF THE INVENTION

The invention relates to a method for optimizing the stereo reception for an analog radio set as well as an associated analog radio receiver.

The invention finds a particularly advantageous application in the field of analog radio set but could also be used in any other type of application where it could be useful to transform two strongly correlated audio signals into a signal of the stereo type.

BACKGROUND OF THE INVENTION

According to prior art, an analog radio set comprises a tuner able to select a channel among a number of frequency channels and to demodulate a first and a second signal contained in the channel. It is known that the first signal G+D (called mono component) corresponds to the sum of the left sound signal and the right sound signal of the stereophony, while the second signal G−D (called stereo component) corresponds to the subtraction of the right sound signal from the left sound signal. When the tuner operates normally, it is easy to combine in a known way the first and the second signal in order to obtain the stereo signal made up by the right sound signal and the left sound signal to be broadcasted.

However, when the reception of the signal by the radio is poor, the energy of the signal G−D tends to decrease, and the stereo signal then tends to be transformed into a mono signal. In other words, in the event of a poor reception, the right and left sound signals obtained tend to be strongly correlated, which decreases the stereophony effect.

OBJECT AND SUMMARY OF THE INVENTION

The purpose of the invention is to allow a stereo broadcast of the signal received in spite of a poor radio reception.

For this purpose, in the method for optimizing the reception according to the invention, a decorrelating module is intended to decorrelate the right and left sound signals received according to a factor of reception quality "alpha" of the radio receiver.

According to the invention, the decorrelation ratio of the decorrelating module is modified according to the factor of reception quality "alpha" for the radio set, in order to restore the stereophony effect of the signal received. Thus, the poorer the reception quality (the lower "alpha" and the more the signals are correlated), the more the decorrelating module will ensure a decorrelation of the right and left signals; while the better the reception quality (the higher "alpha"), the less the decorrelating module will ensure a decorrelation of the right and left signals.

The invention thus relates to a method for optimizing the audiophonic rendering in an analog radio set, wherein said method comprises the following steps:

- a given radio channel is selected among a number of frequency channels,

- the signals in this channel are demodulated in order to obtain a demodulated right sound signal and a demodulated left sound signal,
- the demodulated right sound signal and the demodulated left sound signal are decorrelated, by means of a decorrelating module, so as to obtain signals decorrelated relative to one another corresponding to the optimized right sound signal and the optimized left sound signal, this decorrelating module having a variable decorrelation ratio,
- as the radio set provides a factor of reception quality "alpha", the decorrelation ratio of the decorrelating module is modified according to this factor "alpha", so that the lower the factor of reception quality "alpha" the higher the decorrelation ratio applied by the decorrelating module, and the higher the factor of reception quality "alpha", the lower the decorrelation ratio applied by the decorrelating module.

According to an embodiment:

- the decorrelating module is formed by two elementary blocks to the input of which the demodulated right sound signal and the demodulated left sound signal are applied, the output signal of these blocks corresponding respectively to the optimized right electric sound signal and to the optimized left electric sound signal,
- the output signal of each block being the combination of the input signal of the block weighted by a first gain, and of the combination of the output signal of the block weighted by a second gain and of the input signals of the block delayed by a delay line.

According to an embodiment, in order to modify the decorrelation ratio of the decorrelating module, the gain and delay parameters of the elementary blocks are modified.

According to an embodiment:

- a table giving the correspondence between the parameters of each blocks and the factor of reception quality "alpha" is first stored in a memory, and
- the decorrelation ratio of the decorrelating module is modified by selecting the parameters corresponding to the factor of reception quality "alpha".

According to an embodiment:

for the first elementary block:

$$s_1(n)=e_1(n)\cdot g_1+s_1(n-D1)\cdot g_2+e_1(n-D1)$$

$e_1$ being the input signal of the first block corresponding to the demodulated right sound signal, $s_1$ being the output signal of the first block corresponding to the optimized right sound signal, $g_1$, $g_2$ being respectively the values of the first gain and the second gain of the first block, n being the $n^{th}$ harmonic sample, D1 being the value of the number of delay samples introduced by the delay line, and for the second elementary block:

$$s_2(n)=e_2(n)\cdot g_3+s_2(n-D2)\cdot g_4+e_2(n-D2),$$

$e_2$ being the input signal of the second block corresponding to the demodulated sound signal, $s_2$ being the output signal of the second block corresponding to the optimized sound signal, $g_3$, $g_4$ being respectively the values of the first gain and the second gain of the second block, n being the $n^{th}$ harmonic sample, D2 being the value of the number of delay samples introduced by the delay line.

According to an embodiment, inside the same block, the first gain and the second gain have values opposite one another.

According to an embodiment, the gains of the first block and the gains of the second block have values opposite one another, the value of the first gain of the first block being opposite the value of the first gain of the second block; while the value of the second gain of the first block is opposite the value of the second gain of the second block.

According to an embodiment, the first gain of the first block and the second gain of the second block have a value g; while the second gain of the first block and the first gain of the second block have a value −g.

According to an embodiment, the delays introduced by the delay line of the first elementary block and the delay line of the second elementary block are equal to each other.

According to an embodiment, the demodulated right and left signals are first filtered by means of high-pass filters and only the high frequency part of these signals is applied to the input of the decorrelating module.

According to an embodiment, the low frequency part of the demodulated right and left signals is filtered, the thus-filtered low frequency part is delayed with a third delay, and in order to obtain the optimized right sound signal and the optimized left sound signal, the thus-delayed low frequency parts of the right sound signal and the left sound signal are added respectively to the right sound signal and the left sound signal obtained at the output of the decorrelating module from the high frequency parts of the demodulated left and right signals.

According to an embodiment, the output signals of each elementary block are filtered (in gain and in phase) by means of parametric filtering cells in order to modify the sound perception of these output signals.

According to an embodiment, for each optimized right and left sound signal mainly formed of a low frequency component lower than a cut-off frequency, the highest frequency part from the optimized sound signal is isolated by means of a first filter of the band-pass type, a nonlinear processor which generates the high frequency harmonics of the isolated signal is applied to the isolated part in order to obtain a duplicated signal, a second band-pass filter is applied to the duplicated signal in order to form a high frequency component, the thus-generated high frequency component is combined with the optimized sound signal delayed beforehand by a delay cell, and an increased optimized signal comprising a low frequency component and a regenerated high frequency component is obtained.

According to an embodiment, the upper and lower limits of the band-pass filter depends on the factor of reception quality "alpha".

The invention moreover relates to an optimized analog radio receiver, wherein said optimized analog radio receiver comprises:

a tuner able to select a given radio channel among a number of frequency channels, and to demodulate the signals in this channel in order to obtain a demodulated right sound signal and a demodulated left sound signal, a decorrelating module able to generate, from the demodulated right sound signal and the demodulated left sound signal, signals decorrelated relative to one another corresponding to the optimized right and left sound signals, this decorrelating module having a variable decorrelation ratio, a calculation cell able to provide a factor of reception quality "alpha", the decorrelating module being able to adapt the decorrelation ratio of said decorrelating module according to the factor "alpha" measured, so that the lower the factor of reception quality "alpha" the higher the decorrelation ratio applied by the decorrelating module, and the higher the factor of reception quality "alpha" the lower the decorrelation ratio applied by the decorrelating module.

According to an embodiment, said radio receiver moreover comprises a module for generating treble frequencies including:

a first filter of the band-pass type for isolating the highest frequency part from the optimized sound signal, a nonlinear processor which generates the high frequency harmonics applied to the isolated part of the signal in order to obtain a duplicated signal, a second band-pass filter applied to the duplicated signal in order to form a high frequency component, means for combining the thus-generated high frequency component with the optimized sound signal delayed beforehand by a delay cell, so as to obtain an increased optimized signal comprising a low frequency component and a regenerated high frequency component.

BRIEF DESCRIPTION OF THE DRAWINGS

The invention will be better understood when reading the following description and examining the annexed figures. These figures are given only as an illustration but by no means as a restriction of the invention. They show.

Identical elements keep the same reference throughout the Figures.

DETAILED DESCRIPTION OF THE EMBODIMENTS

Figure 1:
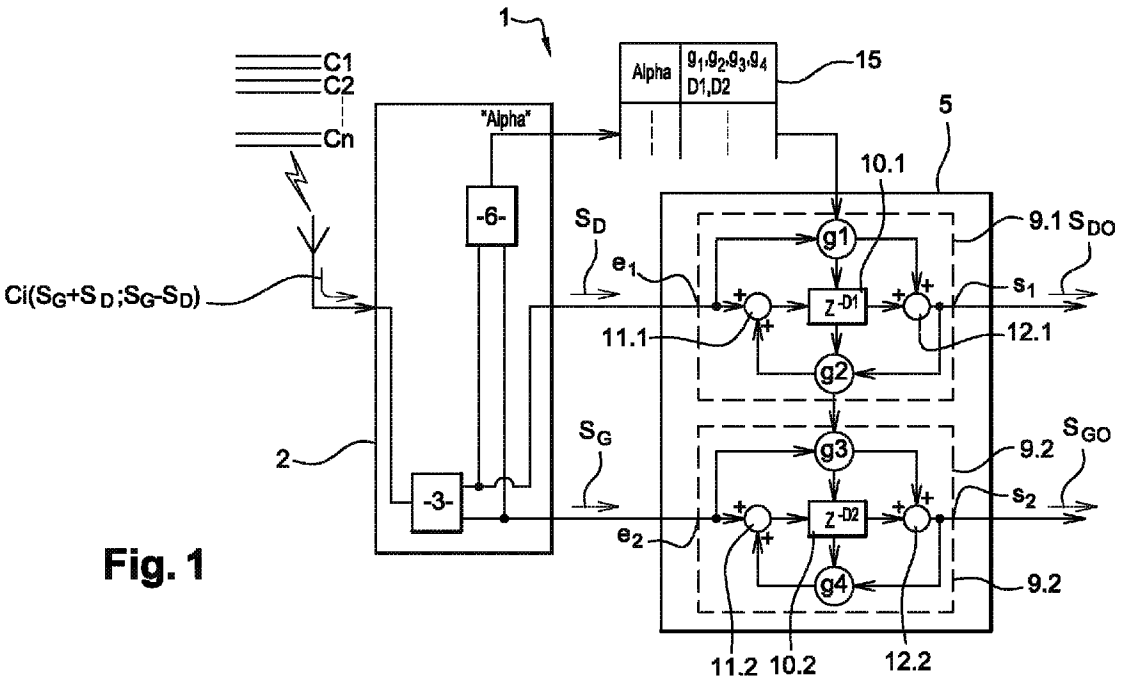
FIG. 1: a schematic representation of a radio set according to the invention provided with a module according to the invention allowing to optimize the radio reception.

FIG. 1 shows a radio set 1 according to the invention provided with a standard analog radio receiver 2 including a tuner 3 in connection with a decorrelating module 5.

In a known way, the tuner 3 is able to select a channel $C_i$ among a number of radio-frequency channels $C_1$-$C_n$ and to demodulate a first and a second signal contained in the channel. It is known that the first signal $S_G+S_D$ corresponds to the sum of the left sound signal $S_G$ and the right sound signal $S_D$; while the second signal corresponds to the signal $S_G-S_D$, i.e. to the subtraction of the right sound signal $S_D$ from the left sound signal $S_G$. The first and the second signal are then combined together in a known way in order to obtain the stereo signal formed by the right sound signal $S_D$ and the demodulated left sound signal $S_G$.

These right $S_D$ and left $S_G$ sound signals are applied to the input of the decorrelating module 5 which will decorrelate them relative to one another according to a factor of reception quality "alpha" provided by the tuner 3. For this purpose, the tuner 3 comprises a calculation cell 6 making it possible to obtain the factor of reception quality alpha. The higher "alpha" is, the closer to the emitted signals the signals $S_G$ and $S_D$ are; while the lower "alpha" is, the more correlated the signals $S_G$ and $S_D$ are (and thus the more the radio tends to function in a monophonic mode).

The variable decorrelation ratio of the module 5 is adapted according to the factor of reception quality "alpha" in order to restore the stereo effect. Thus the more correlated the signals $S_G$ and $S_D$ are (the lower "alpha" is), the higher the decorrelation ratio of the module 5 is; while the closer to the emitted signals the signals $S_G$ and $S_D$ are (the higher "alpha" is), the lower the decorrelation ratio of the decorrelating module is. Thus, in the case of a good reception, it is possible that the decorrelation ratio applied by the decorrelating module 5 is null.

For this purpose, the decorrelating module 5 is made of two elementary blocks 9.1, 9.2 to the input of which the right $S_D$ and left $S_G$ sound signals are respectively applied, the outputs $s_1$, $s_2$ of these blocks 9.1, 9.2 corresponding respectively to the optimized right sound signal $S_{DO}$ and to the optimized left sound signal $S_{GO}$. The output signal $s_1$, $s_2$ of each block 9.1, 9.2 depends on the input signal $e_1$, $e_2$ of the block weighted by a first gain $g_1$, $g_3$ and on the combination of the input signals $e_1$, $e_2$ and of the output signal $s_1$, $s_2$ of the block weighted by a second gain $g_2$, $g_4$ delayed by a delay line 10.1, 10.2.

According to an embodiment, the input signal $e_1$, $e_2$ of the block 9.1, 9.2 is connected to an input of a first adder 11.1, 11.2 and is applied to an input of a second adder 12.1, 12.2 after being multiplied by the first gain $g_1$, $g_3$. The output signal $s_1$, $s_2$ of the block is applied to another input of the first adder 11.1, 11.2 after being multiplied by the second gain $g_2$, $g_4$, the output signal of the first adder 11.1, 11.2 being applied to the input of the delay line 10.1, 10.2. The output signal of the delay line 10.1, 10.2 is applied to another input of the second adder 11.1, 11.2, the output signal of this second adder 11.1, 11.2 corresponding to the output signal $s_1$, $s_2$ of the elementary block 9.1, 9.2 (and thus to the optimized right and left sound signal $S_{DO}$, $S_{GO}$ in FIG. 1).

Thus for the first elementary block 9.1:

$$s_1(n)=e_1(n)\cdot g_1+s_1(n-D1)\cdot g_2+e_1(n-D1)$$

$e_1$ being the input signal of the first block 9.1 corresponding to the demodulated right sound signal $S_D$, $s_1$ being the output signal of the first block 9.1 corresponding to the optimized right sound signal $S_{DO}$, $g_1$, $g_2$ being respectively the values of the first gain and the second gain of the first block 9.1, n being the $n^{th}$ harmonic sample, D1 being the value of the number of delay samples introduced by the delay line 10.1.

For the second elementary block 9.2:

$$s_2(n)=e_2(n)\cdot g_3+s_2(n-D2)\cdot g_4+e_2(n-D2)$$

$e_2$ being the input signal of the second block 9.2 corresponding to the demodulated left sound signal $S_G$, $s_2$ being the output signal of the second block 9.2 corresponding to the optimized left sound signal $S_{GO}$, $g_3$, $g_4$ being respectively the values of the first gain and the second gain of the second block 9.2, n being the $n^{th}$ harmonic sample, D2 being the value of the number of delay samples introduced by the delay line 10.2.

Preferably, inside the same block 9.1 (resp. 9.2), the first gain $g_1$ (resp. $g_3$) and the second gain $g_2$ (resp. $g_4$) have values opposite one another. Each block 9.1, 9.2 behaves then as a filter of the all-pass type which does not modify the gain of the input signal $e_1$, $e_2$ but only the phase thereof.

Moreover, the gains $g_1$, $g_2$ of the first block 9.1 and the gains $g_3$, $g_4$ of the second block 9.2 preferably have values opposite one another. Thus, the value of the first gain $g_1$ of first block 9.1 is opposite the value of the first gain $g_3$ of the second block 9.2; while the value of the second gain $g_2$ of the first block 9.1 is opposite the value of the second gain $g_4$ of the second block 9.2.

Gains for the first 9.1 and the second 9.2 blocks which have an identical absolute value g will also preferably be chosen. Thus preferably, the first gain $g_1$ of the first block 9.1 and the second gain $g_4$ of the second block 9.2 have a value g; while the second gain $g_2$ of the first block 9.1 and the first gain $g_3$ of the second block 9.2 have a value −g.

Preferably, the delays D1, D2 introduced by the delay line 10.1 of the first elementary block 9.1 and the delay line 10.2 of the second elementary block 9.2 are equal to each other and to 176. However, it would be possible to choose delays D1, D2 with different durations.

In order to vary the decorrelation ratio of the decorrelating module 5, the parameters $g_1$, $g_2$, $g_3$, $g_4$, D1, D2 of the elementary blocks 9.1, 9.3 are varied. For this purpose, a table 15 stored in a memory gives the correspondence between the parameters of each block 9.1, 9.2 (first gain $g_1$, $g_3$ and second gain $g_2$, $g_4$ and delay D1, D2 of the line 10.1, 10.2) and the factor of reception quality "alpha", the parameters of each block 9.1, 9.2 being selected according to the factor of reception quality "alpha" provided by the radio.

Figure 2:
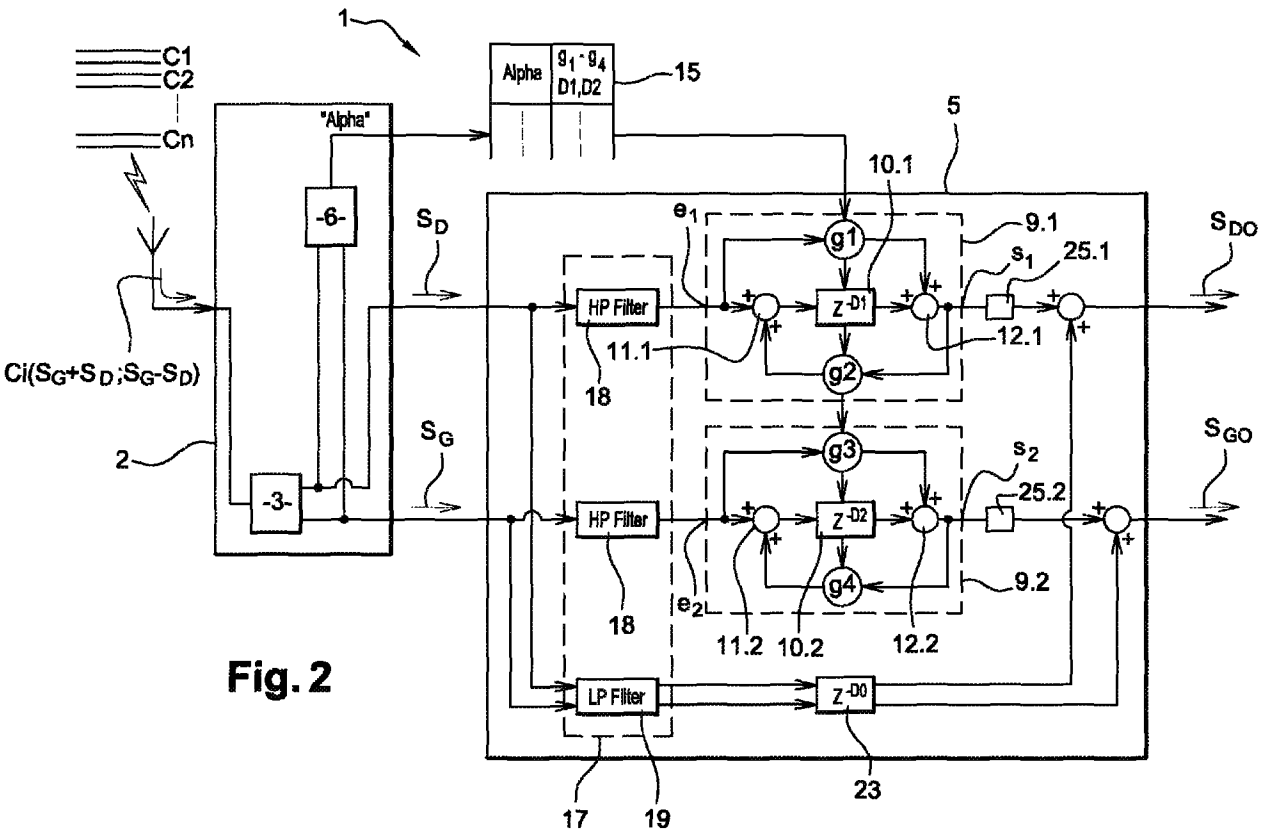
FIG. 2: a schematic representation of an improved embodiment of the invention in which the low frequency part of the right and left signals is not applied to the input of the decorrelating module according to the invention.

In an improvement of the invention shown in FIG. 2, one moreover uses a stage 17 made up of high-pass filters 18 and of low-pass filters 19 making it possible to separate the low frequencies signals from the high frequency signals in the right $S_D$ and left $S_G$ signals. In this case, only the high frequency part of the right $S_D$ and left $S_G$ signals is applied to the input of the decorrelating module 5.

The low frequency part of the right $S_D$ and left $S_G$ signals is applied to the input of a third delay line 23 and the low frequencies parts of the thus-delayed right $S_D$ and left $S_G$ signals are added respectively to the signals obtained at the outputs of the blocks 9.1, 9.2, so as to obtain the optimized right and left sound signals $S_{DO}$ and $S_{GO}$.

That makes it possible to improve the final sound rendering because one realizes that the low frequency signals are statistically very correlated, it is not therefore advisable to decorrelate them by means of the decorrelating module for otherwise the general audiophonic perception would not be nice to hear.

In an example, the delay D3 of the third line 23 is equal to 176 (at a sampling rate of 44.1 KHz).

Moreover, it is possible to use parametric equalization cells 25.1, 25.2 connected to the output of each elementary block 9.1, 9.2 before adding to the delayed low frequency part. These equalization cells cause the modification of the perception of the output signals $s_1$, $s_2$ of these blocks 9.1, 9.2 because, even if the signals $s_1$, $s_2$ have substantially identical levels, there are differences in the perception thereof because of the decorrelation relative to one another. Consequently, it can be useful to modify these signals from a perceptive point of view so that the general sound impression is as best as possible.

For this purpose, each equalization cell 25.1, 25.2 comprises a filter whose gain and phase can be adjusted according to various frequency bands of the signals $s_1$, $s_2$ and a gain which acts on all the spectrum of the signals $s_1$, $s_2$. These gain and phase parameters are adapted by sound engineers in particular according to the application considered.

It is noted that the worse the reception quality is, the more one tends to suppress the high frequency part from the signals received because the parasites are generally located in the high frequency bands. On the other hand, the better the reception quality is, the more one tends to keep the high frequency component of the signals received.

The invention makes it possible to regenerate a high frequency component of the right $S_{DO}$ or left $S_{GO}$ sound signals that has been suppressed in the event of a poor reception. This aspect of the invention is independent of the technical principle of the generation of stereophony in the event of a poor reception and could thus be implemented independently of this principle.

Figure 3:
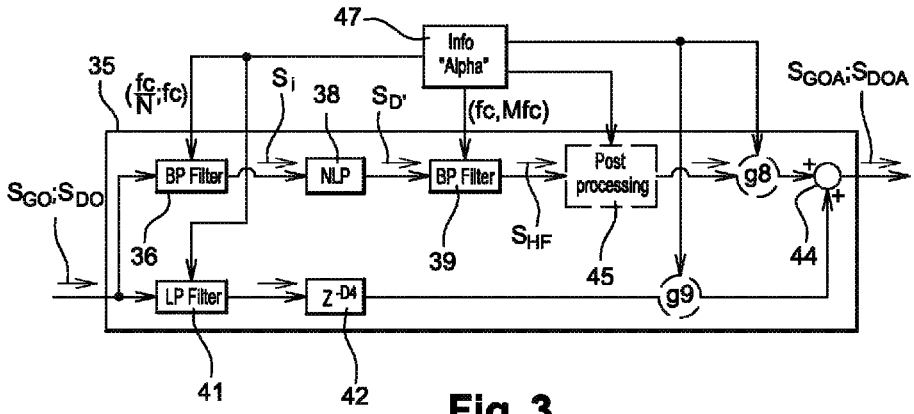
FIG. 3: a schematic representation of a module for generating the high frequency component for the stereo sound signals to be broadcast.
Figure 4A:
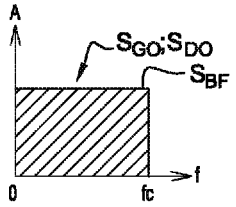
FIGS. 4*a*-4*e*: very schematic representations of the signals that can be observed when using the module for generating the high frequency component in FIG. 3.

For this purpose, the left $S_{GO}$ and right $S_{DO}$ sound signals, which are mainly made of a low frequency component $S_{BF}$ lower than the cut-off frequency $f_C$ (see FIG. 4*a*), are each applied to the input of a module 35 for generating treble frequencies shown in details in FIG. 3

Figure 4B:
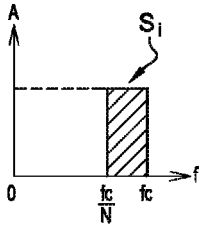

This module 35 comprises a first band-pass filter 36 to the input of which the left $S_{GO}$ (resp. right $S_{DR}$) sound signal is applied. This first filter 36 makes it possible to isolate the highest frequency part from the $S_{GO}$ (resp $S_{DO}$) input signal comprised between a lower limit and an upper limit. In an example, the upper limit is equal to the cut-off frequency $f_C$, and the lower limit is equal to $f_C/N$, N preferably being equal to 2 or 4. The isolated part Si of the signal obtained at the output of the band-pass filter 36 is shown in FIG. 4*b*.

Figure 4C:
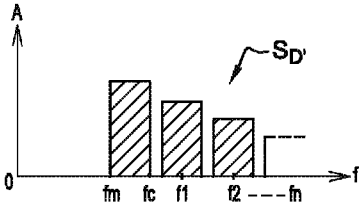

The isolated part Si is then applied to the input of the processor 38 of a nonlinear type which makes it possible to duplicate the isolated signal Si with regard to the frequency by generating the high frequency harmonics at $f_1$, $f_2 \ldots f_n$ of this signal Si, which makes it possible to fill the frequency spectrum in the zone of the high frequencies. The duplicated signal $S_{D'}$ thus obtained at the output of the nonlinear processor 38 is shown in FIG. 4*c*. Preferably, as represented, the harmonics of the signal $S_{D'}$ have an amplitude which decrease as the frequency increases.

Figure 4D:
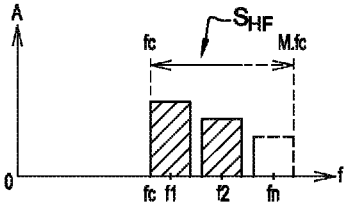
Figure 4E:
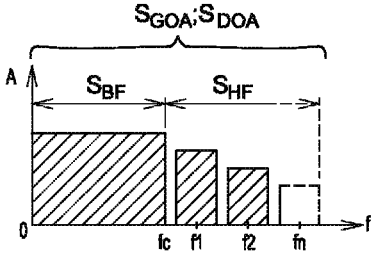

Then the high frequency part of the duplicated signal $S_{D'}$ (without the isolated part Si from which it has been obtained) is isolated in order to obtain a high frequency component $S_{HF}$ of the sound signal shown in FIG. 4*d*. For this purpose, a band-pass filter 39 is used with a lower limit and an upper limit. In an example, the lower limit is equal to $f_C$ while the upper limit is equal to $M \cdot f_C$, M being equal for example to 2 or 4.

In addition, the restored left $S_{GO}$ (resp. right $S_{DO}$) sound signal is filtered by means of a low-pass filter 41 having a cut-off frequency substantially equal to $f_C$ in order to keep only the low frequency component $S_{BF}$ of the restored signal $S_{GR}$, $S_{DR}$. The low frequency part $S_{BF}$ is then delayed by a delay D4 by means of a delay cell 42. This delay D4 is about a few samples.

Then, the low frequency component $S_{BF}$ is added to the high frequency component $S_{HF}$ by means of a adder 44, in order to obtain an increased optimized left $S_{GOA}$ (resp. right $S_{DOA}$) sound signal formed of the initial low frequency component $S_{BF}$ of the optimized sound signal and the high frequency component $S_{HF}$ thus generated by the method according to the invention.

Preferably, but that is not obligatory, a post-processing cell 45 modifies the form of the spectral response of the high frequency component $S_{HF}$, and the gains $g_8$ and $g_9$ are applied to the high frequency $S_{HF}$ and low frequency $S_{BF}$ components before addition by the adder 44.

The parameters of the filters 36, 39, 41 depend on the factor of reception quality "alpha". Indeed, the filters 36, 39, 41 have limits that depend on the cut-off frequency $f_C$. As this cut-off frequency $f_C$ depends on the factor "alpha", the limits also depend on the factor "alpha". There is thus a table 47 giving the correspondence between the factor of reception quality "alpha" and the associated filter parameters making it possible to generate the high frequency component of the left and right sound signals.

The parameters of the post-processing cell 45, of the nonlinear processor 38, of the delay cell 42, and of gains $g_8$ and $g_9$ also preferably depend on the factor of reception quality "alpha".

The parameters of the modules for generating treble frequencies 35 which process the left sound signal $S_{GR}$ and the right sound signal $S_{DR}$ are preferably symmetrical, i.e. the module 35 which processes the left sound signal $S_{GR}$ has parameters of the same value as the module 35 which processes the right sound signal $S_{DR}$.

The invention claimed is:

1. A method for optimizing the stereo reception in an analog radio set, comprising the steps of:

selecting a radio channel from a plurality of frequency channels;

demodulating signals in the selected radio channel to obtain a demodulated right sound signal and a demodulated left sound signal;

decorrelating the demodulated right sound signal and the demodulated left sound signal by a decorrelating module to obtain signals de-correlated relative to one another respectively called an optimized right sound signal and an optimized left sound signal, the de-correlating module having a variable de-correlation ratio;

providing an alpha factor of reception quality by the radio set; and modifying the decorrelation ratio of the decorrelating module inversely based on the alpha factor of reception quality such that the decorrelating module such that the decorrelation module increases the decorrelation ratio applied with decreasing alpha factor of reception quality and decreases the decorrelation ratio applied with increasing alpha factor of reception quality.

2. The method of claim 1, further comprising the step of applying the demodulated right sound signal and the demodulated left signal as an input to the decorrelating module formed by two elementary blocks, output signals of the two elementary blocks corresponding respectively to the optimized right sound signal and to the optimized left sound signal; and wherein the output signal of each elementary block being the combination of the input signal of said each elementary block weighted by a first gain, of the output signal of said each elementary block weighted by a second gain and of the input signal of said each elementary block delayed by a delay line.

3. The method of claim 2, further comprising the step of modifying the gain and delay parameters of the elementary blocks to modify the decorrelation ratio of the decorrelation module.

4. The method of claim 2, further comprising the steps of storing a table providing the correspondence between the parameters of each elementary block and the alpha factor of reception quality in a memory; and modifying the decorrelation ratio of the decorrelating module by selecting the parameters corresponding to the alpha factor of quality of reception.

5. The method of claim 2, wherein the output signal ($s_1$) for the first elementary block corresponding to the optimized right sound signal is defined by $s_1(n)=e_1(n)\cdot g_1+s_1(n-D1)\cdot g_2+e_1(n-D1)$, where $e_1$ being the input signal of the first block corresponding to the demodulated right sound signal, $g_1$ and $g_2$ being respectively the values of the first gain and the second gain of the first elementary block, n being $n^{th}$ harmonic sample, and D1 being the value of number of delay samples introduced by the delay line; and wherein the output signal ($s_2$) for the second elementary block corresponding to the optimized left sound signal is defined by $s_2(n)=e_2(n)\cdot g_3+s_2(n-D2)\cdot g_4+e_2(n-D2)$, where $e_2$ being the input signal of the second block corresponding to the demodulated left sound signal, $g_4$ and $g_3$ being respectively the values of the first gain and the second gain of the second elementary block, n being $n^{th}$ harmonic sample, and D2 being the value of the number of delay samples introduced by the delay line.

6. The method of claim 2, wherein the first gain and the second gain have values opposite one another inside a same elementary block.

7. The method of claim 2, wherein the gains of the first elementary block and the gains of the second elementary block have values opposite one another, the value of the first gain of the first elementary block being opposite the value of the first gain of the second block and the value of the second gain of the first elementary block is opposite the value of the second gain of the second elementary block.

8. The method of claim 2, wherein the first gain of the first elementary block and the second gain of the second elementary block have a value g; and wherein the second gain of the first elementary block and the first gain of the second elementary block have a value −g.

9. The method of claim 2, wherein the delays introduced by the delay line of the first elementary block and by the delay line of the second elementary block are equal to one another.

10. The method of claim 2, further comprising the step of filtering gain and phase of the output signals of each elementary block by parametric filtering cells to modify sound perception of the output signals.

11. The method of claim 1, further comprising the steps of filtering the demodulated right and left signals by high-pass filters and applying only high frequency parts of the demodulated right and left signals to an input of the decorrelating module.

12. The method of claim 11, further comprising the steps of:

filtering low frequency parts of the demodulated right and left sound signals;

delaying the filtered low frequency parts with a third delay; and adding the delayed low frequency parts of the right sound signal and of the left sound signal respectively to the right sound signal and the left sound signal obtained at the output of the decorrelating module from the high frequency parts of the demodulated left and right sound signals to obtain the optimized right sound signal and the optimized left sound signal.

13. The method of claim 1, further comprising, for each optimized right and left sound signal substantially formed of a low frequency component lower than a cut-off frequency, the steps of:

isolating a highest frequency part from the optimized sound signal by a first band-pass filter;

applying high frequency harmonics of an isolated signal generated by a nonlinear processor to the isolated part to obtain a duplicated signal;

applying a second band-pass filter to the duplicated signal to form a high frequency component; and combining the high frequency component with the optimized sound signal delayed by a delay cell to obtain an increased optimized signal comprising a low frequency component and a regenerated high frequency component.

14. The method of claim 13, wherein upper and lower limits of the band-pass filters depend on the alpha factor of reception quality.

15. An optimized analog radio receiver, comprising:

a tuner to select a radio channel from a plurality of frequency channels, and to demodulate signals in the selected radio channel to obtain a demodulated right sound signal and a demodulated left sound signal;

a decorrelating module to generate, from the demodulated right sound signal and the demodulated left sound signal, signals decorrelated relative to one another respectively called optimized right sound signal and optimized left sound signal, the decorrelating module having a variable decorrelation ratio;

a calculation cell to provide an alpha factor of reception quality; and wherein the decorrelating module is operable to adapt the decorrelation ratio of the decorrelating module inversely based on a measured alpha factor of reception quality such that the decorrelation module increases the decorrelation ratio applied with decreasing alpha factor of reception quality and decreases the decorrelation ratio applied with increasing alpha factor of reception quality.

16. The radio receiver of claim 15, further comprising a module for generating treble frequencies and comprising:

a first band-pass filter to isolate a highest frequency part from each optimized sound signal;

a nonlinear processor to generate and apply high frequency harmonics to the isolated part of said each signal to obtain a duplicated signal;

a second band-pass filter applied to the duplicated signal to form a high frequency component; and a combiner for combining the high frequency component with said each optimized sound signal delayed by a delay cell to obtain an increased optimized signal comprising a low frequency component and a regenerated high frequency component.

* * * * *